US012791204B2

(12) United States Patent
Rahman

(10) Patent No.: US 12,791,204 B2
(45) Date of Patent: Nov. 10, 2026

(54) SPACE SERVICING ASSEMBLY

(71) Applicant: Sajidur Rahman, London (GB)

(72) Inventor: Sajidur Rahman, London (GB)

( * ) Notice: Subject to any disclaimer, the term of this patent is extended or adjusted under 35 U.S.C. 154(b) by 316 days.

(21) Appl. No.: 18/685,057

(22) PCT Filed: Aug. 18, 2022

(86) PCT No.: PCT/EP2022/073132
§ 371 (c)(1),
(2) Date: Feb. 20, 2024

(87) PCT Pub. No.: WO2023/021164
PCT Pub. Date: Feb. 23, 2023

(65) Prior Publication Data

US 2024/0353119 A1 Oct. 24, 2024

(30) Foreign Application Priority Data

Aug. 18, 2021 (GB) ..... 2111842

(51) Int. Cl.
*B01D 53/02* (2006.01)
*F24F 1/0047* (2019.01)
(Continued)

(52) U.S. Cl.
CPC ..... *F24F 1/0328* (2019.02); *F24F 1/0047* (2019.02); *F24F 8/10* (2021.01);
(Continued)

(58) Field of Classification Search
CPC ..... F24F 1/0047; F24F 1/0071; F24F 1/0314; F24F 1/0328; F24F 11/32; F24F 11/33; F24F 11/39; F24F 11/52; F24F 11/526; F24F 11/89; F24F 2110/10; F24F 2110/20; F24F 2110/50; F24F 2110/65; F24F 2110/66; F24F 2110/70; F24F 2130/30;
(Continued)

(56) References Cited

U.S. PATENT DOCUMENTS 5,167,677 A * 12/1992 Hammes ..... F24D 19/061 55/DIG. 35
5,641,354 A * 6/1997 Sakauchi ..... F24F 3/163 414/217
(Continued)

FOREIGN PATENT DOCUMENTS

EP 3855087 A1 1/2021
WO 2019186527 A1 10/2019

*Primary Examiner* — Christopher P Jones
(74) *Attorney, Agent, or Firm* — William H. Bollman

(57) ABSTRACT

A space servicing assembly for a space within a building, the space servicing assembly comprising: a housing; at least one sensor within the housing for monitoring a value of air quality within the space; at least one space servicing device within the housing for altering the value of air quality within the space; and, a control means configured to receive the value from the at least one sensor and provide an output and/or control the space servicing device to alter the value, whereby, in use, the space servicing assembly is configured to compare a monitored value with one or more predetermined value, and to provide an output to alert a user and/or control the space servicing device to alter the monitored value to match the predetermined value.

18 Claims, 8 Drawing Sheets

(51) Int. Cl.

| | |
|---|---|
| ***F24F 1/0328*** | (2019.01) |
| ***F24F 8/10*** | (2021.01) |
| ***F24F 8/22*** | (2021.01) |
| ***F24F 11/526*** | (2018.01) |
| *F24F 110/50* | (2018.01) |

(52) U.S. Cl.
CPC ..... *F24F 8/22* (2021.01); *F24F 11/526* (2018.01); *F24F 2110/50* (2018.01); *F24F 2221/14* (2013.01)

(58) Field of Classification Search
CPC ..... F24F 2130/40; F24F 2221/02; F24F 2221/14; F24F 8/10; F24F 8/22; Y02B 30/70
See application file for complete search history.

(56) References Cited

U.S. PATENT DOCUMENTS

| | | | | |
|---|---|---|---|---|
| 6,460,364 | B1 * | 10/2002 | Tufo | F24F 11/62 62/285 |
| 7,908,879 | B1 * | 3/2011 | Chen | F24F 1/0041 62/259.1 |
| 10,767,880 | B2 | 9/2020 | Leeland | |
| 2005/0160706 | A1 * | 7/2005 | Kim | F24F 8/10 55/385.2 |
| 2005/0191219 | A1 | 9/2005 | Uslenghi | |
| 2005/0272364 | A1 * | 12/2005 | Lee | F24F 8/167 454/235 |
| 2016/0269236 | A1 * | 9/2016 | Chan | H04L 41/0886 |
| 2017/0087500 | A1 * | 3/2017 | Combs | B01D 46/429 |
| 2021/0003310 | A1 * | 1/2021 | Shnaiderman | F24F 11/30 |
| 2021/0213382 | A1 * | 7/2021 | Cole | F24F 11/56 |

* cited by examiner

SPACE SERVICING ASSEMBLY

This invention pertains generally to the field of space servicing assemblies and in particular an intelligent space servicing assembly for use within commercial and residential buildings.

The provision of services to a space within a building, and the condition of the air within a building environment is extremely important to the health and comfort of people who spend any time within that environment. Numerous systems and devices are often used to help to service the space, and condition the air within that space, with the aim being to provide an acceptable air quality and provide a comfortable environment. Typically, the infrastructure required to support and deliver all these numerous systems and devices can prove challenging. Firstly, building services engineers must analyse a space, estimate the capacity and design a provision of services to suit that space. Secondly, speciality mechanical contractors and suppliers must install the various services within that space, whilst abiding by any compliance codes and inspections. Thirdly, users of the space must control any systems and devices to service the space and maintain required levels of air quality and comfort during their use. The devices and systems must be monitored and maintained, and elements such as filters must be replaced. Finally, through a change of use of a space, all of the installed systems and devices must be removed and disposed of, to allow for the installation of different systems within that space. There are a number of problems presented by the existing life cycle of this services infrastructure.

The first issue is to provide a system to fit an existing infrastructure or building environment. No two environments are ever the same, and the requirements for users within the space can vary greatly too. Some compromises are required due to the fixed nature of the equipment available. Existing systems are not reconfigurable to fit all existing infrastructures. Installation of any chosen systems take considerable time, typically requires that the space be empty, and can cause a great deal of dust and detritus within the space, not to mention the noise during the installation process.

Typically, the ceiling space behind a suspended ceiling can often become cluttered with various devices, ducting, power lines and other kit. All this kit has the aim of servicing a space and providing sufficient air quality to the space that it feeds, to provide user comfort. However, some of these systems provide insufficient air flow, and typically create pockets of stale air within the space. User controls can be somewhat limited, with a user guessing whether they should make any changes to the devices to deliver a different output in air quality. These systems being largely reactive rather than proactive. The user isn't often provided with feedback upon which they can generate a response, such as an alert to a drop in air quality.

In many modern buildings, the design, installation and control of these space servicing devices such as air conditioners, are integrated into one or more Heating Ventilation and Air Conditioning (HVAC) systems. This can help to improve the clutter caused by multiple devices. But there is little intuitive control of such systems, based on real-time feedback. They typically all require user input.

Existing space servicing systems and devices within buildings also raise considerable issues with their impact on climate change. The carbon footprint of buildings, or carbon emissions from buildings are thought to be responsible for around forty percent of carbon emissions in the UK, through construction, use and end-of-life. Corporations are committing to carbon neutrality yet there are very few solutions on the market to help with this. These buildings are wasting a considerable amount of energy each day. Many governments have committed to go carbon neutral by 2050 with a number of corporations promising carbon neutrality by 2030. However current solutions, products and regulations are far from achieving the target.

One of the main issues with existing space servicing systems and devices is the lack of communication between hardware, software, the various service providers, users of the space and maintenance experts. The result of this lack of communication typically leads to overselling of unnecessary products, poor performance of installations and higher-than-necessary energy demand and energy waste figures.

Staff retention can also be key to the profitability of a business. Up to ninety percent of a business's expense is their staff, yet most corporations do not invest enough time or money on enhancing their staff experience. Studies show that a healthy and well-designed workspace will enhance the mood of its occupants. Carbon dioxide build up is a good example of this. It slows down mental alertness and makes users feel sluggish. Yet typical systems do not have carbon dioxide detection means nor do they have the technology in place to remove some of this carbon dioxide from the air space. An intuitively serviced air space is key to the comfort of its users.

Controlling air quality is another largely forgotten element. Typical control systems are somewhat limited, with a means to perhaps alter the temperature within a space. More often than not the controls are barely used, with predetermined settings being left in place, and perhaps altered with the seasons. Or used reactively, such as when a user is too hot, they switch on the cold air device to help to cool the space down. Inefficient and ineffective use of the equipment provided.

A further problem is the fact that most installations are bespoke and specific to a particular building or room. As soon as that room changes use, through relocation, expansion or suchlike, the installed devices cannot typically be moved. These devices often end up as waste, being dumped in landfill.

There is a need for an intuitive system of services for a space, and to improve the air flow within that space, providing laminar flow and preventing pockets of stale air. There is a need to deliver an intuitive space servicing arrangement that can be installed and reconfigured to meet the changing needs of any space, and that is movable and relocatable between spaces. There is a need for an intuitive, real-time feedback loop to control these air conditioning devices, to ensure the service requirements and air quality within a space are met at any time. There is a need to prevent unnecessary energy wastage and reduce carbon emissions with an air conditioning system within a building.

The prior art shows a number of devices which attempt to address these needs in various ways.

CN 205 245 441 (Shenzhen Xi'Ao Ind Co Ltd) discloses a suspended ceiling system with illumination, ventilation and air purification means. The unit incorporates at least one sensor, a lighting device and two vents, along with filtration means and a carbon filter screen. The system goes someway towards an all-in-one air conditioning system, to improve air quality within an environment.

US 10 310 464 (Phorena Inc) discloses a smart devices kit for a recessed light housing. This kit comprises smart devices and sensors that fit inside wall or ceiling mounted lighting assemblies, where the kit can be retrofitted as a hub for multiple, modular, interchangeable smart devices and sensors. These smart devices and sensors are controlled by hardware and software that are connected with each other, wirelessly or otherwise.

Whilst the prior art appears to address the issue of combining services that feed into a space, and improving air quality within that space, whilst also incorporating intuitive control of these services by users of the space, it still requires user input to activate any changes to the system and therefore the conditions within a space. Whilst the prior art also aims to address the problem with retrofitting existing kit and existing devices for delivering services to a space, it does not allow for ease of installation and maintenance of said devices within the space, nor does it allow for relocation of the devices to another space if required. Whilst it also aims to provide modular, plug-and-play systems of devices, to prevent unnecessary clutter behind a suspended ceiling, there is a limit on size, and how many, or which devices can be used with the system. The prior art does not consider the issues of climate change and tracking and preventing energy wastage and carbon emissions.

Preferred embodiments of the present invention aim to provide a modular space servicing assembly for an air space, where the reconfigurable space servicing components can be easily installed, reconfigured, controlled, maintained and relocated, and the modular space servicing assembly senses and responds to achieve predetermined settings and air quality targets within that space. Preferred embodiments of the present invention also aim to provide a space servicing assembly that delivers a predetermined value of air quality throughout a space. Further preferred embodiments of the present invention aim to provide minimal energy wastage of an air conditioning system, through intuitive controls and sensing means.

According to one aspect of the present invention, there is provided a space servicing assembly for a space within a building, the space servicing assembly comprising: a housing; at least one sensor within the housing for monitoring a value of air quality within the space; at least one space servicing device within the housing for altering the value of air quality within the space; and, a control means configured to receive the value from the at least one sensor and provide an output and/or control the space servicing device to alter the value, whereby, in use, the space servicing assembly is configured to compare a monitored value with one or more predetermined value, and to provide an output to alert a user and/or control the space servicing device to alter the monitored value to match the predetermined value.

The at least one sensor may comprise one or more of the following: carbon dioxide sensor, proximity sensor, volatile organic compound sensor, light level sensor, noise level sensor, smoke detector, temperature sensor, humidity sensor, filter condition sensor.

The at least one space servicing device may comprise one or more of the following: air extraction means, air filtration means, air treatment means, acoustic means, heating, cooling.

The output may comprise a visual alert and/or audible alert.

Preferably, the output may be wirelessly transmitted to an operating interface.

The operating interface may comprise a smartphone or tablet.

The operating interface may be operable to change the predetermined value.

Preferably, the housing may comprise a front panel.

The front panel may incorporate one or more of the following: speaker, lighting means, ultraviolet lighting means, microphones.

The front panel may incorporate the at least one sensors.

Preferably, the housing may comprise a plurality of compartments.

Preferably, each of the plurality of compartments may be configured to house a specific space servicing device.

Each of the compartments may be operatively connected to power.

Preferably, the housing may incorporate a plurality of perforations for air distribution.

The space servicing assembly may incorporate a rear cover for preventing the ingress of dust and/or detritus.

The space servicing assembly may be configured to continuously compare a monitored value with one or more predetermined value, and to provide a real-time output to alert a user, and/or control the space servicing device to alter the monitored value to match the predetermined value.

The space servicing assembly may be configured to intermittently compare a monitored value with one or more predetermined value, at predetermined times or at timed intervals.

Preferably, the space servicing assembly may be hingedly mounted to a ceiling frame assembly, such that one side of the housing can be rotatably lowered for access.

For a better understanding of the invention and to show how embodiments of the same may be carried into effect, reference will now be made, by way of example, to the accompanying diagrammatic drawings, in which.

In the figures like references denote like or corresponding parts.

Figure 1:
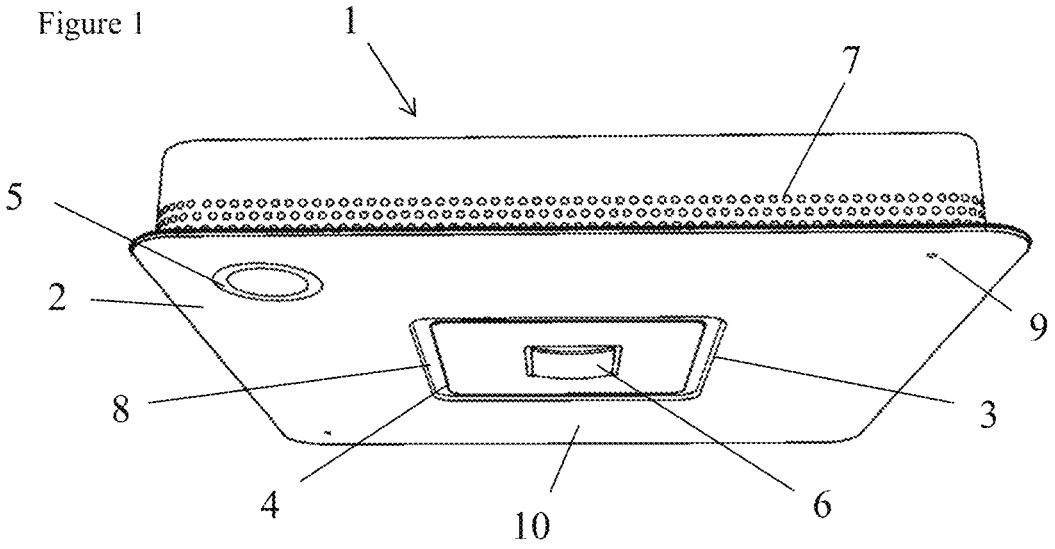
FIG. 1 shows one embodiment of space servicing assembly, showing a housing with a front panel, and one possible arrangement of outlets for space servicing devices within the panel.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

FIG. 1 shows one possible embodiment of space servicing assembly 1 comprising a housing 2. The housing 2 is made up of a frame and a front panel 10, where the front panel 10 faces into a space that is to be serviced by the space servicing assembly 1. The front panel 10 incorporates a lighting means 3. The front panel 10 may also comprise means to support one or more speakers 5 in position, for conveying audio to the space. The front panel 10 may incorporate one or more microphones 9 for picking up audio signals from within the space. The front panel 10 may also incorporate a plurality of sensors 6 for sensing various conditions within the space. In the embodiment shown, the space servicing assembly comprises air extraction means for drawing air from a space through a lighting recess of the lighting means 3. The frame or walls of the housing 2 incorporate a plurality of perforations 7 for air distribution means.

The front panel 10 may comprise an Interchangeable facing which allows for ease of replacement of typically the most worn element of the space servicing assembly 1. The front panel 10 may be made available in a number of different colours and materials to suit different environments. The material of the front panel 10 may have acoustic reverberation minimizing qualities as standard. Where the finish of the front panel 10 is a fabric material, any microphones or speakers may be inbuilt to sit behind this layer. The housing 2 will likely comprise shells of pressed steel or a steel casing. The housing 2 may ensure that the space servicing assembly 1 sits flush with a ceiling, or where embedded within a wall, with the surface of the wall, not shown.

Figure 2:
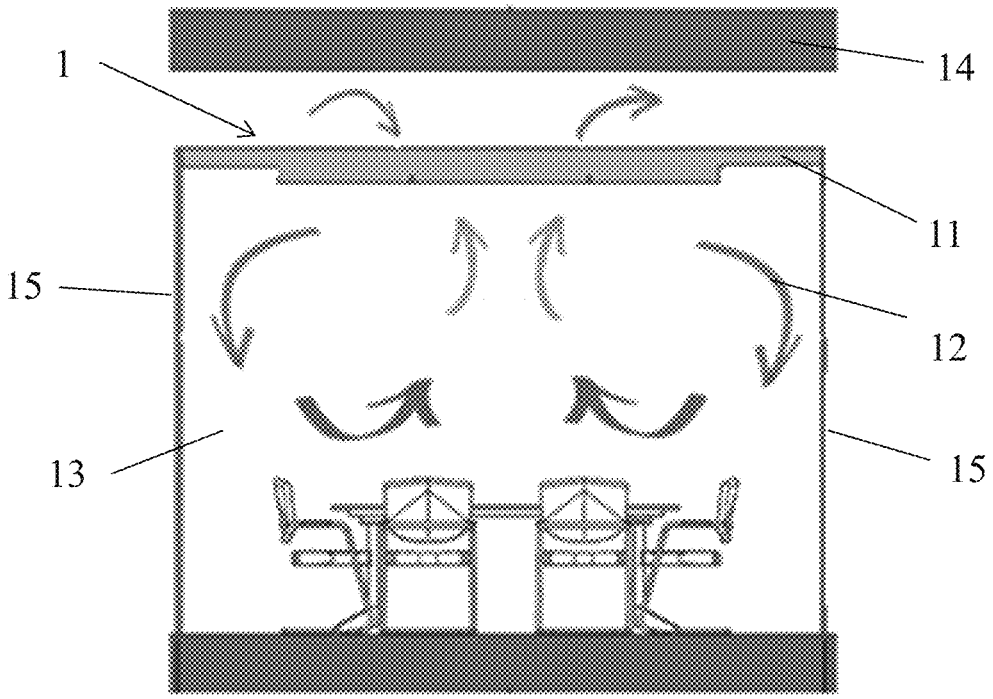
FIG. 2 shows a diagrammatic view of the space servicing assembly of FIG. 1 installed within a suspended ceiling framework above a space to be serviced, showing laminar air flow generated by the space servicing assembly within the space.

The space servicing assembly 1 comprises a single unit that delivers a system of services for a space, where the space may comprise a room within a building, and in particular a commercial building such as a block of offices or suchlike. FIG. 2 shows the space servicing assembly 1 when configured within a suspended ceiling 11, mounted a short distance beneath an existing ceiling 14 of a room. The space servicing assembly 1 may also be incorporated within a wall 15 of a room or space, not shown. The space servicing assembly 1 creates an air flow 12, drawing air from a space 13, and supplying air into the space from behind the suspended ceiling 11 through ducting, pipework or similar, conditioning this air flow according to requirements and supplying this to the space, as and when required. The space servicing assembly 1 provides a single unit of services to cover all of the services that may be required by users of the space 13. The arrangement of the space servicing assembly 1 encourages laminar air flow 12 throughout the space 13, reducing areas of stale air and ensuring quality air that meets with user requirements throughout the space 13.

The space servicing assembly 1 provides a laminar air flow for hyper efficiency of cooling and air exchanges. This is provided by the plurality of perforations 7 that spread the air evenly. Laminar airflow is defined as air moving at the same speed and in the same direction, with no or minimal cross-over of air streams. Laminar airflow is initially used as a cooling method by removing warm air through extraction and by having 360-degree air supply which passes over a user giving a cooling effect. The remainder of the cooling demand, which is now lower, may be done mechanically. The space 13 may be flushed with air as and when required, such as between meetings or when the occupancy of the space changes.

Figure 3A:
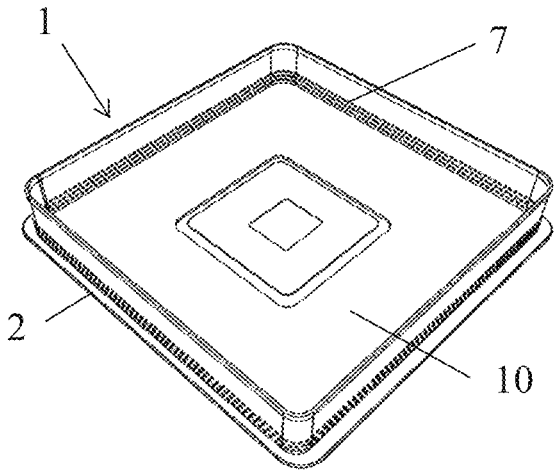
FIG. 3A shows one arrangement of the interior of the housing of the space servicing assembly of FIG. 1 with cover removed.
Figure 3B:
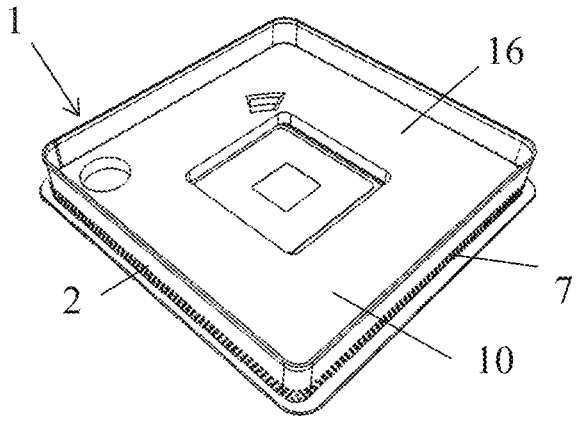
FIG. 3B shows the arrangement of the interior of the housing of the space servicing assembly of FIG. 3A, showing one embodiment of air distribution layer.

FIGS. 3A and 3B show one embodiment of the housing 2 showing the internal structure created by the shell of the housing 2 for containing the various space servicing devices 20, not shown. FIG. 3B shows one embodiment of air distribution layer 16 for supporting the distribution of the air flow being drawn into, serviced, and forced out of the space servicing assembly 1.

Figure 4:
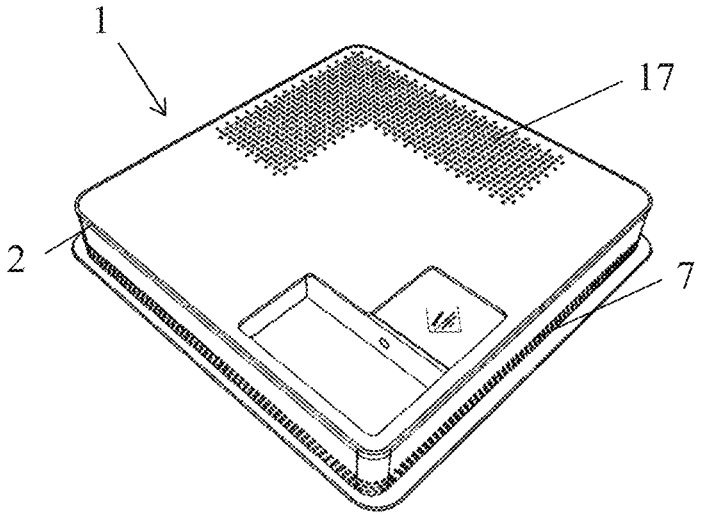
FIG. 4 shows one embodiment of rear cover for the space servicing assembly.

FIG. 4 shows the space servicing assembly 1 provided with a rear cover 17 for wholly containing the space servicing devices 20 that make up the space servicing assembly 1 and preventing dust and other detritus from gaining access.

Figure 5:
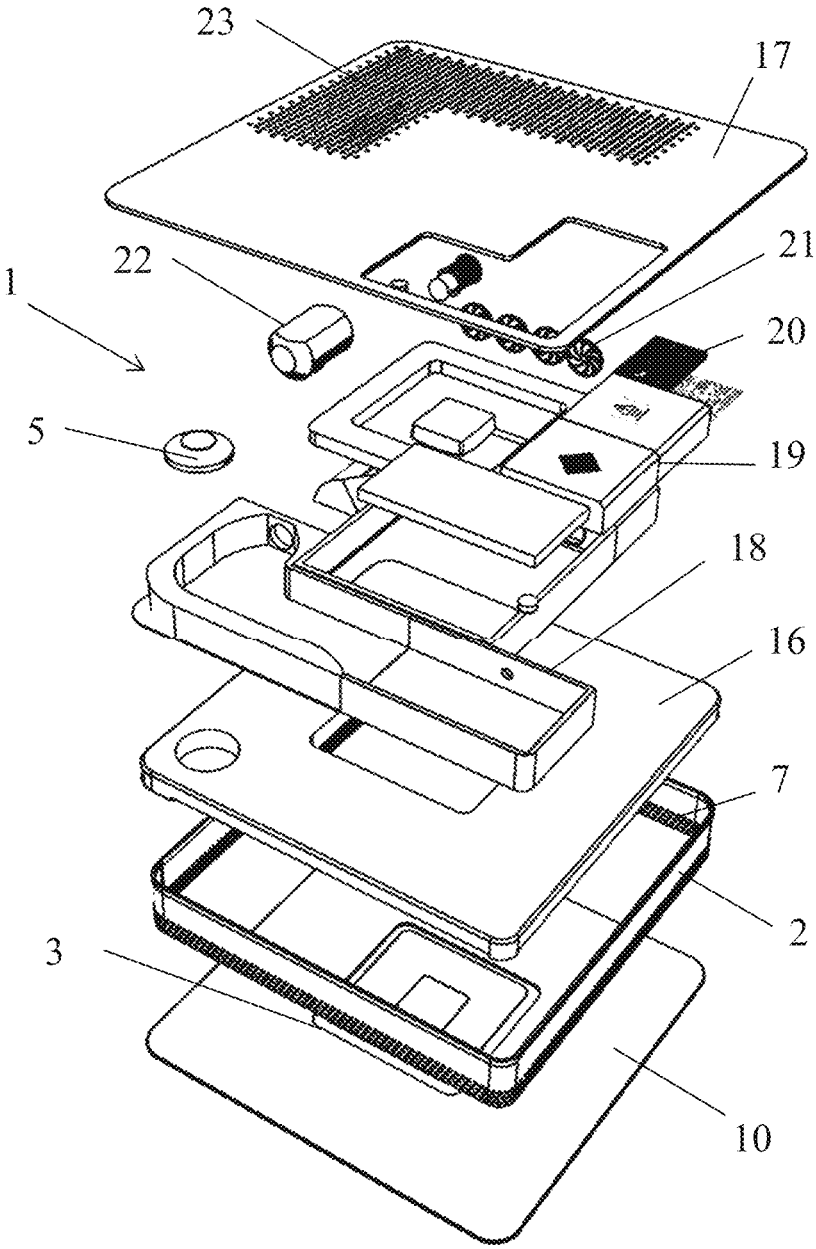
FIG. 5 shows an exploded view of the space servicing assembly of FIG. 1, shown from the underside and therefore the rear cover, showing one arrangement of compartments into which space servicing devices can be operatively connected.
Figure 6:
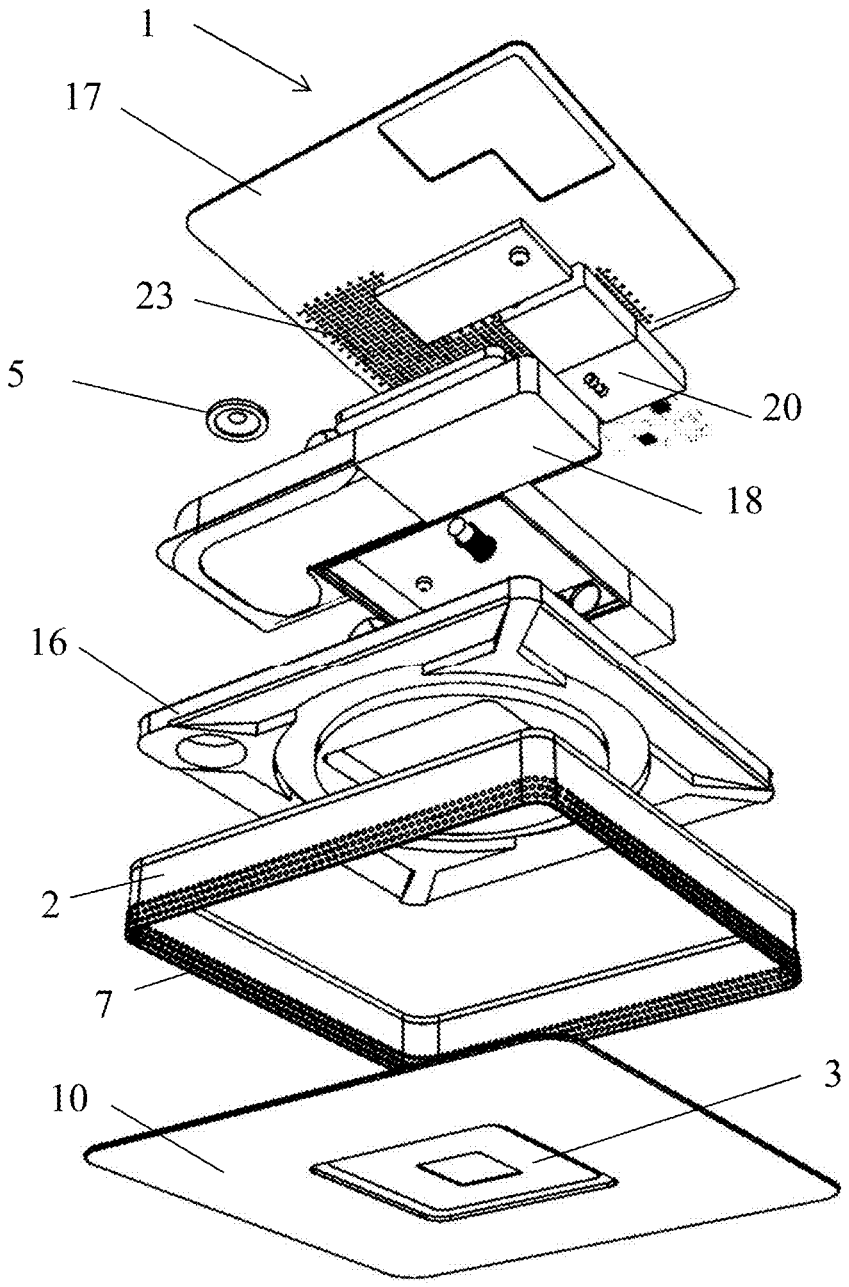
FIG. 6 shows an exploded view of the space servicing assembly of FIG. 1, shown from the front panel side, showing the layers that support the space servicing devices.

FIGS. 5 and 6 show exploded views of the space servicing assembly 1, with FIG. 5 being from the direction of the rear cover 17, and FIG. 6 being from the direction of the front panel 10. The space servicing assembly 1 in one embodiment comprises a modular arrangement of layers, into which a plurality of space servicing devices 20 can be plugged. The same housing 2 can therefore house any number of these space servicing devices 20 in designated compartments 18. The space servicing devices 20 can effectively 'plug and play' within these compartments 18. The compartments 18 ensure that the space servicing devices 20 are operatively connected to power and to any facilities that they need to function. The arrangement of compartments 18 also ensures an optimum layout of space servicing devices 20. The space servicing devices 20 may include, but are not limited to, lighting means, air treatment means, air extraction means, air moving means, air filtration means. The rear cover 17 may incorporate one or more air inlets, not shown.

Figure 7:
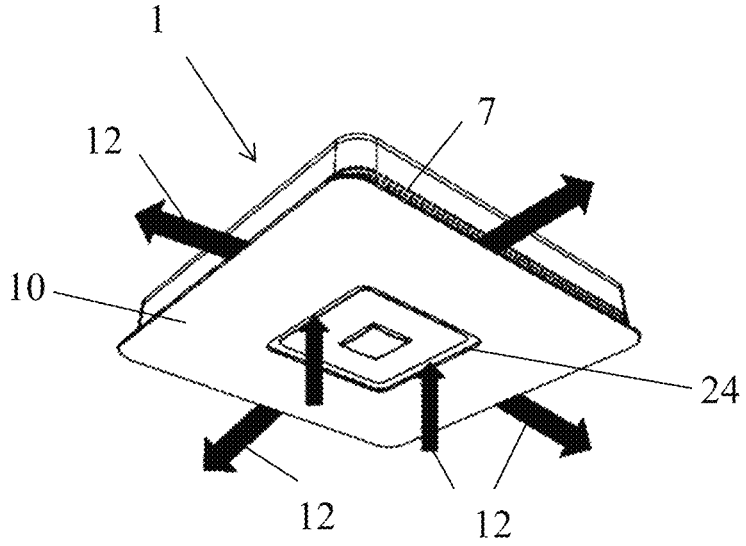
FIG. 7 shows a diagrammatic view of the air flow through the front panel and housing of the space servicing assembly, showing air being drawn in through a lighting recess, supplied from the ceiling space above, before being conditioned and forced out through perforations in the housing.
Figure 8A:
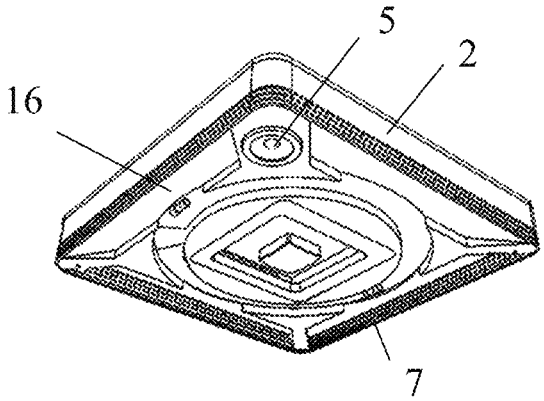
FIGS. 8A and 8B show one embodiment of air distribution layer, with FIG. 8B showing air flow through said air distribution layer.
Figure 8B:
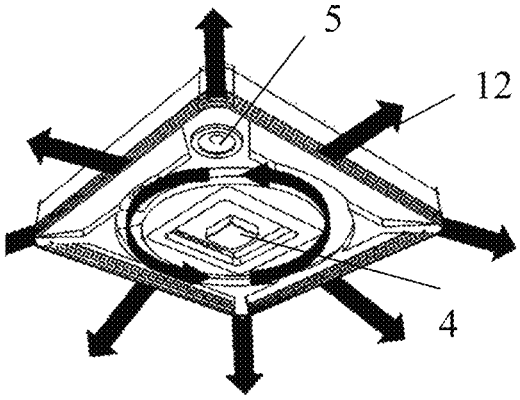

Alongside the air distribution layer 16 sits the compartmentalised layer, which comprises electrical insulation 19 where required, and houses the space servicing devices 20, whilst also incorporating one or more fans 21 for driving the air flow 12. FIG. 7 is a diagrammatic view of the air flow 12 being drawn up through a lighting recess 24 of the lighting means 3, to be extracted as waste through ducting, pipework or otherwise, and air being supplied to the space through ducting or pipework entering the space servicing assembly 1, via at least one filter, where it can be treated according to predetermined requirements, then redistributed out through the perforations 7 of the housing 2. FIGS. 8A and 8B show a detailed view of the air distribution layer 16 with air circulating and accelerating within the layer prior to being forced out through the perforations 7 or outlet vents, not shown.

Figure 9:
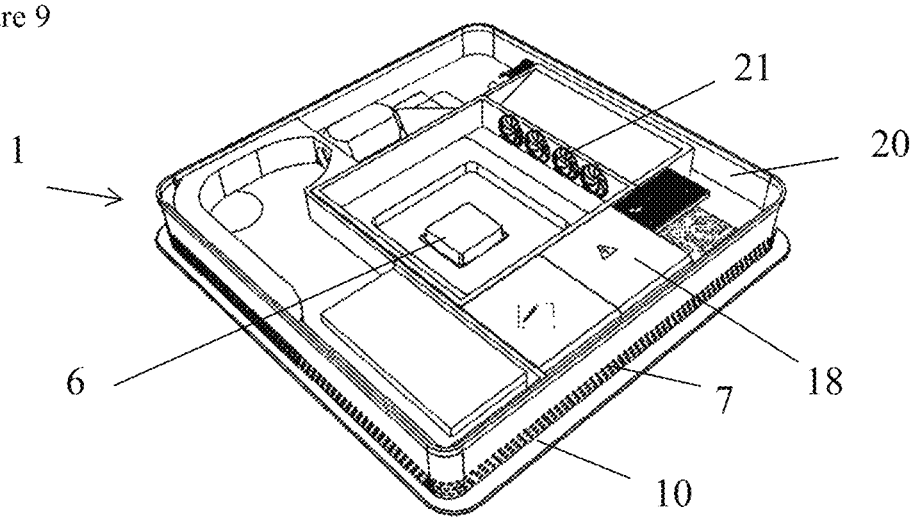
FIG. 9 shows one arrangement of space servicing devices operatively connected within the housing.
Figure 10:
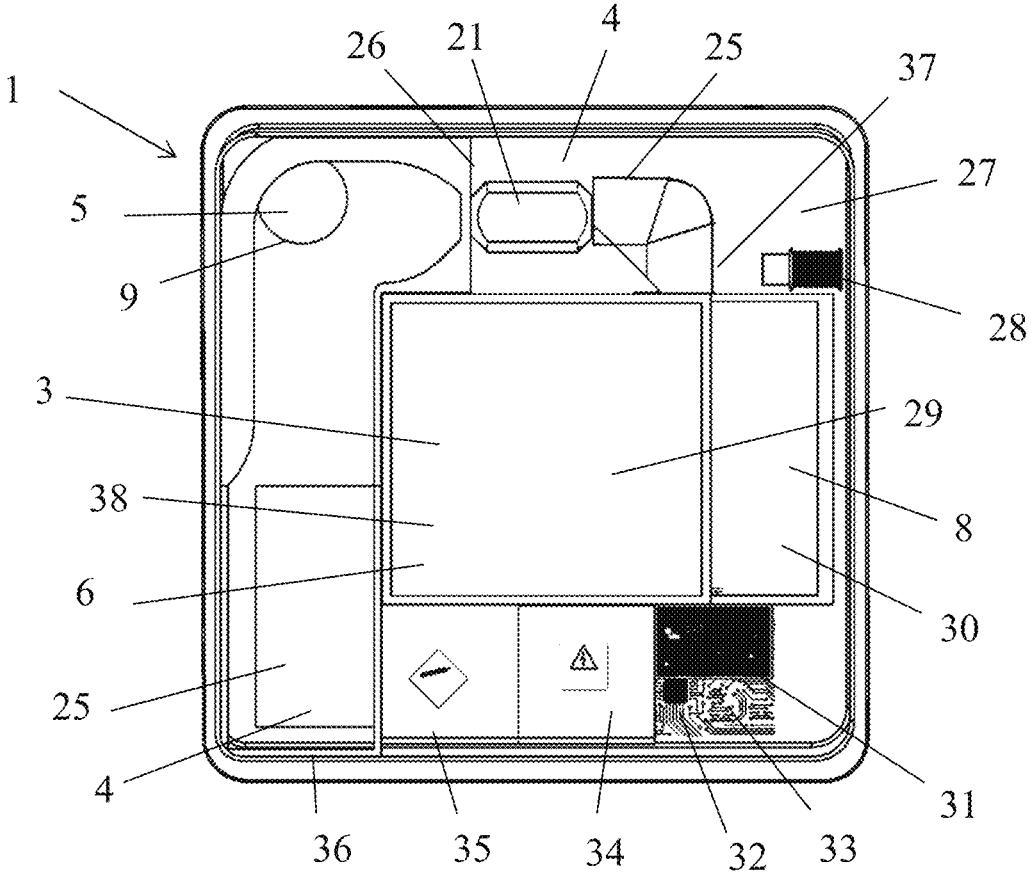
FIG. 10 shows a plan view of the space servicing devices of FIG. 9.

FIGS. 9 and 10 show one embodiment of space servicing devices 20 configured within compartments 18 that make up a mechanical and electrical layer. The space servicing devices 20 that are added to this layer or plugged into the designated compartments 18 are decided upon according to the requirements of the space 13 that the space servicing assembly 1 is servicing. The space servicing devices 20 may therefore include one or more from a list of options, and one or more of the same option. These options include various filters 25 for filtering air fed into the space 13. They may also include heating means 26, for heating the air passing therethrough, or cooling means 27 for cooling the air passing therethrough. The mechanical and electrical layer will likely comprise compartments 18 formed from pressed steel, which provides sufficient strength and fire compartmentalisation, whilst allowing the space servicing devices 20 to be easily replaced as and when required.

The space servicing assembly 1 may incorporate carbon dioxide sensing means as one of a plurality of sensors 6. The sensor 6 would detect when the level of carbon dioxide within a space has exceeded a predetermined level and alert a user accordingly. Further sensors 6 may include one or more of the following: proximity sensor, volatile organic compound sensor (VOC), light level sensor, noise level sensor, smoke detector, temperature sensor, humidity sensor.

The operation of the space servicing devices 20 may be by remote control or may be intuitive and in response to a reading from one of a plurality of different sensing means or sensors 6 built into the space servicing assembly 1. FIG. 10 shows a central chamber 29 for air circulation means, and air extraction means 8 provided with a mesh cover 30. Also shown is one embodiment of control means 31 or means for receiving a signal wirelessly from a remote control means, that sits alongside a server 32 for data handling and machine learning. There is also a power pack or power 34 for operatively connecting to all space servicing devices 20 that require power, and air treatment means 35 for providing additives to treat the air flow. A PCB 38 provides the required circuitry to drive the components that make up this layer of the space servicing assembly 1.

Air is drawn into this layer through an air inlet 36, circulated within the chamber 16, filtered by one or more filters 25, provided with additives by the air treatment means 35, prior to being ejected through the air outlet 37. The air treatment means 35 may comprise a fragrance and be injected into the air flow by injectable aerosols. The space servicing assembly 1 may be programmed to release specific fragrance aerosols at specific times, or in response to specific conditions being sensed. The air treatment means 35 may comprise an antibacterial additive, in particle form, that can be sprayed onto all surfaces in the space 13 for pathogen cleaning of the air within that space 13. All pathogens and bacteria within the space 13 can be removed through a combination of air treatment means 35, such as through air filtration means 4 comprising one or more filters 25, ultraviolet lighting as part of any lighting means 3, and through the addition of pathogen killing additives.

Figure 11:
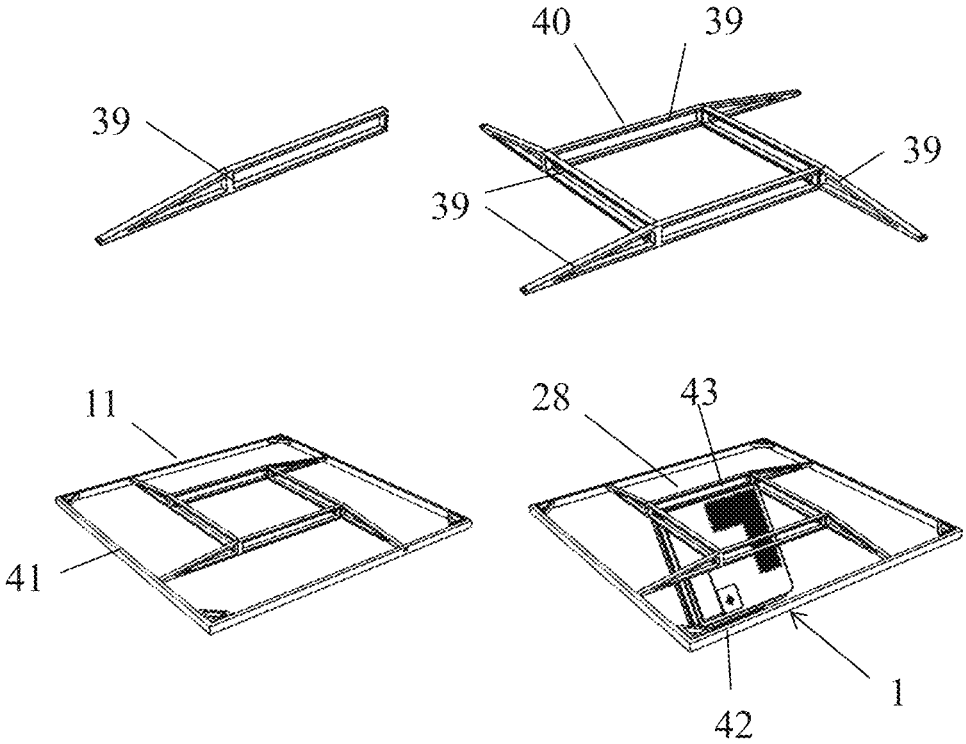
FIG. 11 shows one embodiment of frame assembly made up of frame elements for suspending the space servicing assembly in position above a space, showing a single element, an arrangement of four frame elements, the four frame elements when aligned with an existing head track, and one embodiment of hinged access means for accessing the space servicing devices within the space servicing assembly.

FIG. 11 shows one arrangement of frame assembly 40 to support the space servicing assembly 1 as a suspended ceiling 11 in a room or above a space 13. This embodiment of frame assembly 40 is made up of four identical frame elements 39, configured to span from a corner of the room, to leave a square space therebetween for supporting the space servicing assembly 1. The frame assembly 40 may span from an existing head track 41, or a head track 41 may be installed for supporting the frame assembly 40. The space servicing assembly 1 may be provided with convenient means for dropping one side into the room below, comprising a hinge 43, so that a user or maintenance personnel can gain access to the space servicing devices 20 contained therein. This may be to change a filter 25, service a device, or check that the system is running efficiently. Filter change warnings may be sent to the user through the software and replacements may be automatically sent out from a manufacturer. The drop-down feature for the space servicing assembly 1 eliminates ladder use and the dangers of working at heights. The hinge 43 may allow a rotation of an access door, or the space servicing assembly 1, through any angle as required for convenient access. This hinge 43 may support the device at an angle of 45 degrees for the user, or alternatively at an angle of 90 degrees relative to the ceiling for installation or engineer's maintenance without the need for ladder access.

Figure 12:
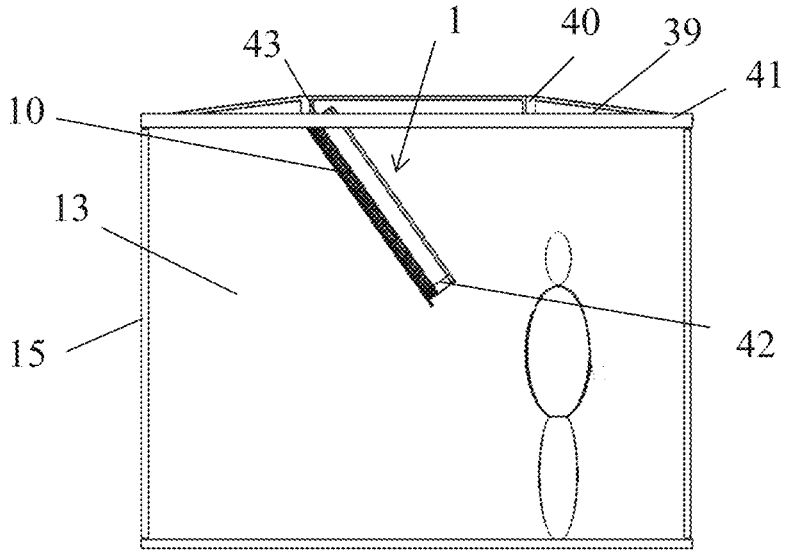
FIG. 12 shows the one embodiment of hinged access means in close up view, showing a user lowering the space servicing assembly for maintenance purposes; and, FIG. 13 shows one embodiment of remote control for remote controlling the space servicing assembly, the remote control being wall-mounted.

FIG. 12 shows this drop-down arrangement in more detail, where the frame assembly 40, and/or housing 2 is provided with a catch or locking means 42 for unlocking to lower for access. In one embodiment the frame assembly 40 has been designed for structural support of the ceiling infill or suspended ceiling 11. The frame assembly 40 of the space servicing assembly 1 and its extension and locking means 42 allows the frame assembly 40 to lock onto the majority of existing partition system frameworks.

Figure 13:
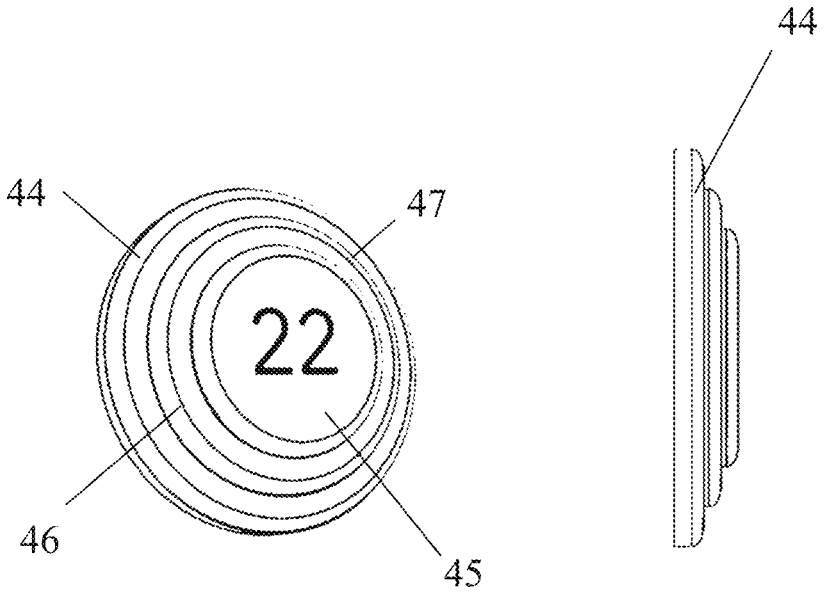

FIG. 13 shows one embodiment of wall-mounted control means 44 that provides remote control for the space servicing assembly 1. The control means 44 can be conveniently located on a wall 15 for users to be able to easily alter the settings to make the space more comfortable for their use. The control means 44 may incorporate a display 45 for feedback information such as room temperature, a dial 46 for accessing and making changes to various settings, and wireless connectivity 47 to talk to the space servicing assembly 1. The control means 44 may comprise one or more circular disks or dials 46 that rotate independently to adjust 3 parameters such as lighting level, volume and room temperature. The double-digit display 45 in the middle will display a reading for the specific parameter currently being adjusted. The control means 44 could rotate 360 degrees but could also only rotate say 45 degrees in any direction to prompt the adjustment of the setting. The control means 44 may generate its own power through kinetic movement or rotation of the dials 47.

Control of the lighting level, and therefore of the lighting means 3, is stated in building regulations and guidelines to an extent, but the quality of the lighting or colour is not covered. Many standards suggest ideal lighting types and colour for best human performance as well as their circadian rhythm. The space servicing assembly 1 may automatically mimic daylight and change settings gradually to mimic evening light levels and nightime light levels to allow the user's circadian cycle to remain steady for better work, sleep and mood. The key to human wellbeing for any user operating within the space and making use of the space servicing assembly 1 is thought to be to maintain the lighting quality between the range of 90 to 100 Colour Render Index (CRI). The space servicing assembly 1 can be programmed to maintain the quality of lighting within this range.

The control means 44 may also be through a smartphone or tablet device, not shown. A downloadable Application or App for the smartphone or tablet will allow for complete control of the space servicing assembly 1, whilst also allowing for real-time and historical data to be accessed as and when required.

The software which runs the space servicing assembly 1 will be based on user behaviour and machine learning to optimise performance against the design criteria from current industry guidelines and standards. The software will obtain and store data from the various sensors 6. Data collection on performance and human health will be used and analysed, and reports generated for the user. The user may also be provided with health improvement tips for a healthy work-life balance.

The sensors 6 may generate a reading for Indoor Air Quality (IAQ). If the IAQ drops below a predetermined level, alerts will be sent to the user or maintenance professional to notify them that there could be external issues that need to be addressed. In the meantime, the space servicing assembly 1 may automatically adjust its performance to return the air quality to the desired, or pre-programmed, level.

The software may incorporate pre-sets for a new user to provide guidance on settings and operation of the space servicing assembly 1. For an example, if the space 13 is to be used by a single occupant and the occupant is female, then research currently suggests that females prefer a space 13 to be 2° C. higher than males. The pre-set for a female occupant would therefore incorporate this.

The software through the App or similar may incorporate personalised operation, data collection and interpretation, and carbon data offsetting. The software calculates carbon usage, educates as to how to improve and lessen the impact, and obtains data for future analysis.

The space servicing assembly 1 is configured to purify or clean the air, but is also configured to provide all necessary services a user may need within a closed environment such as an office, hotel room or other closed room.

The space servicing assembly 1 provides advanced air processing services that may include, but are not limited to, carbon filtering and air born germ removal, whilst also providing additional services such as air enhancement through ionisation, security such as door and/or window locking, fire alarm activation, lighting and ways of wireless communication to the outside world via the user's smart phone or other devices. The space servicing assembly 1 effectively services the space, providing all the different services required within that space. The space servicing assembly 1 combines all the services into one compact space. air processing volume that both meets and exceeds building regulations which means it can ensure air within the room eventually reaches the desired state at which time the space servicing assembly 1 can slow down, stop the external filtered air incoming by closing the damper, and only recirculating the air within the room.

The space servicing assembly 1 may be configured to provide dehumidification functionality to dehumidify the air within a space. A dehumidifier module, not shown, may be connected into the layers of the space servicing assembly 1, and provided with power to drive said device and service the space by removing any humidity or moisture within the air, thus helping user comfort.

The space servicing assembly 1 may incorporate a flush mode where any fans can be accelerated to full speed to enable the fan to flush the air within the air space as quickly and as conveniently as possible. The space servicing assembly may also comprise an emergency cut off means for stopping any fans or delivery of optimised air to an air space that, in the event of a fire, will prevent the device from providing fuel for the fire in the form of fresh air. A smoke detector may provide the trigger to activate this emergency cut-off means, not shown in the figures.

Additionally, in event of a fire or smoke being detected, alerts may be sent automatically to any users within the building or to a nominated emergency contact to alert to the presence of the fire and ensure that any personnel within the space are alerted that they need to evacuate.

The space servicing assembly 1 may incorporate a function where the device has the ability to switch the supply of air from only within the room to only from outside of the space.

The space servicing assembly 1 is proficient at changing the air within an air space. In one embodiment the air contained within any ductwork that has been processed by the space servicing assembly 1 is pressurised. This pressurisation occurs by passing the air through a plurality of smaller holes relative to the volume of air contained within the ductwork. This ensures that the processed air travels to fill the entire space. The accelerated air can reach further into the space that the space servicing assembly 1 is servicing.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivatives) indicates one feature or more that is preferred but not essential.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent, or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A space servicing assembly for a space within a building, the space servicing assembly comprising:

a housing configured to be mounted in or beneath a suspended ceiling above the space and comprising a front panel facing the space;

at least one sensor incorporated in the housing for monitoring a value of air quality within the space;

at least one space servicing device within the housing for altering the value of air quality within the space;

a control means configured to receive a monitored value from the at least one sensor and control the at least one space servicing device, wherein the space servicing device comprises an air extraction means configured to draw air from the space through a lighting recess defined in the front panel, the housing is configured to receive air from a ceiling space behind the housing and to redistribute the received air into the space through a plurality of perforations in the housing, such that, in use, air is drawn from the space through the lighting recess, conditioned within the housing, and redistributed through the perforations to generate a substantially laminar airflow across the space, and wherein the control means is configured to compare the monitored value with one or more predetermined values and to provide an output to alert a user of a change in the monitored value and to control the at least one space servicing device to alter the monitored value toward the predetermined value.

2. The space servicing assembly according to claim 1, wherein the at least one sensor comprises one or more of the following: carbon dioxide sensor, proximity sensor, volatile organic compound sensor, light level sensor, noise level sensor, smoke detector, temperature sensor, humidity sensor, filter condition sensor.

3. The space servicing assembly according to claim 1, wherein the at least one space servicing device comprises one or more of the following: air filtration means, air treatment means, acoustic means, heating, cooling.

4. The space servicing assembly according to claim 1, wherein the output comprises a visual alert and/or audible alert.

5. The space servicing assembly according to claim 4, wherein the output is wirelessly transmitted to an operating interface.

6. The space servicing assembly according to claim 5, wherein the operating interface comprises a smartphone or tablet.

7. The space servicing assembly according to claim 5, wherein the operating interface is operable to change the predetermined value.

8. The space servicing assembly according to claim 1, wherein the housing comprises the front panel and the front panel incorporates the at least one sensor.

9. The space servicing assembly according to claim 8, wherein the front panel incorporates one or more of the following: speaker, lighting means, ultraviolet lighting means, microphones.

10. The space servicing assembly according to claim 8, wherein the front panel incorporates the at least one sensor.

11. The space servicing assembly according to claim 1, wherein the housing comprises a plurality of compartments.

12. The space servicing assembly according to claim 11, wherein each of the plurality of compartments is configured to receive a respective space servicing device in a plug-and-play manner.

13. The space servicing assembly according to claim 11, wherein each of the plurality of compartments is operatively connected to power.

14. The space servicing assembly according to claim 1, wherein the housing incorporates a plurality of perforations for air distribution.

15. The space servicing assembly according to claim 1, wherein the space servicing assembly incorporates a rear cover for preventing the ingress of dust and/or detritus.

16. The space servicing assembly according to claim 1, wherein the space servicing assembly is configured to continuously compare a monitored value with one or more predetermined value, and to provide a real-time output to alert a user, and/or control the space servicing device to alter the monitored value to match the predetermined value.

17. The space servicing assembly according to claim 1, wherein the space servicing assembly is configured to intermittently compare a monitored value with one or more predetermined value, at predetermined times or at timed intervals.

18. The space servicing assembly according to claim 1, wherein the space servicing assembly is hingedly mounted to a ceiling frame assembly, such that one side of the housing can be rotatably lowered for access.

* * * * *